US007954258B2

(12) United States Patent
Gerber

(10) Patent No.: US 7,954,258 B2
(45) Date of Patent: Jun. 7, 2011

(54) ARTICLE OF FOOTWEAR WITH WALLED CLEAT SYSTEM

(75) Inventor: Clifford B. Gerber, West Linn, OR (US)

(73) Assignee: NIKE, Inc., Beaverton, OR (US)

( * ) Notice: Subject to any disclaimer, the term of this patent is extended or adjusted under 35 U.S.C. 154(b) by 902 days.

(21) Appl. No.: 11/873,908

(22) Filed: Oct. 17, 2007

(65) Prior Publication Data

US 2009/0100716 A1 Apr. 23, 2009

(51) Int. Cl.
*A43B 5/00* (2006.01)

(52) U.S. Cl. ..... 36/59 R; 36/67 R; 36/114

(58) Field of Classification Search ..... 36/67 R, 36/59 R, 67 A, 59 C, 127–129, 134, 114
See application file for complete search history.

(56) References Cited

U.S. PATENT DOCUMENTS

| | | | | | |
|---|---|---|---|---|---|
| 1,594,056 | A | * | 7/1926 | Floyd | 36/59 R |
| 3,127,687 | A | * | 4/1964 | Hollister et al. | 36/114 |
| 4,173,083 | A | | 11/1979 | Infusino | |
| 4,212,120 | A | * | 7/1980 | Bowerman et al. | 36/129 |
| 4,327,503 | A | | 5/1982 | Johnson | |
| 4,335,529 | A | | 6/1982 | Badalamenti | |
| 4,546,559 | A | * | 10/1985 | Dassler | 36/129 |
| 4,590,693 | A | | 5/1986 | Kawashima et al. | |
| 4,642,917 | A | | 2/1987 | Ungar | |
| 4,667,425 | A | | 5/1987 | Effler et al. | |
| 4,689,901 | A | * | 9/1987 | Ihlenburg | 36/126 |
| 4,782,604 | A | * | 11/1988 | Wen-Shown | 36/127 |
| 4,885,851 | A | * | 12/1989 | Peterson | 36/127 |
| D356,672 | S | | 3/1995 | Ueda | |
| 5,533,282 | A | * | 7/1996 | Kataoka et al. | 36/129 |
| 5,943,794 | A | * | 8/1999 | Gelsomini | 36/127 |
| 5,979,083 | A | * | 11/1999 | Robinson et al. | 36/127 |
| 6,016,613 | A | * | 1/2000 | Campbell et al. | 36/59 C |
| 6,018,893 | A | * | 2/2000 | Workman | 36/134 |
| 6,101,746 | A | * | 8/2000 | Evans | 36/128 |
| 6,354,022 | B2 | * | 3/2002 | Gelsomini | 36/127 |
| 6,557,270 | B2 | * | 5/2003 | Nakano et al. | 36/25 R |
| 6,705,027 | B1 | * | 3/2004 | Campbell | 36/127 |
| 6,810,605 | B2 | * | 11/2004 | Nakano et al. | 36/25 R |
| 7,100,309 | B2 | * | 9/2006 | Smith et al. | 36/28 |
| 7,428,790 | B2 | * | 9/2008 | Pellerin | 36/134 |
| 2002/0004999 | A1 | | 1/2002 | Caine et al. | |

FOREIGN PATENT DOCUMENTS

| | | |
|---|---|---|
| WO | WO 9009117 | 8/1990 |

OTHER PUBLICATIONS

International Preliminary Report on Patentability mailed Apr. 29, 2010 in PCT Application No. PCT/US2008/080083.

* cited by examiner

*Primary Examiner* — Marie Patterson
(74) *Attorney, Agent, or Firm* — Plumsea Law Group, LLC

(57) ABSTRACT

An article of footwear with primary cleats and secondary cleats is disclosed. The primary and secondary cleats are preferably disposed on an outer peripheral zone of a forefoot portion of a sole and present a walled cleat system on a portion of the outer peripheral zone. The article of footwear also includes bladed toe cleats.

20 Claims, 5 Drawing Sheets

ARTICLE OF FOOTWEAR WITH WALLED CLEAT SYSTEM

BACKGROUND OF THE INVENTION

1. Field of the Invention

This invention relates to an article of footwear and, more particularly, to a sports shoe with a walled cleat system.

2. Description of Related Art

Articles of footwear with cleats disposed on a periphery have been previously proposed. Kawashima (U.S. Pat. No. 4,590,693) teaches a baseball or softball shoe with its sole having a plurality of individual spikes. The shoe also includes a plurality of projections that are integrally formed with the sole and adjacent to a periphery of the sole. Kawashima teaches the use of the projections to prevent the spikes from deeply penetrating into the ground to provide stabilization of the sole. Additionally, the projections may help reduce injury to another player by the spikes when the sole hits against another player.

Effler (U.S. Pat. No. 4,667,425) teaches a baseball shoe. The shoe includes first cleats that have a generally flat rectangular-shaped ground engaging surface. Effler teaches that the first cleats are located around the periphery of the toe and ball sections and in the heel section. Effler teaches that the ground engaging surfaces of the first cleats are made small to enhance ground penetration of the first cleats. Furthermore, the base of the first cleats is wide to enhance the strength of the first cleats.

Kawashima and Effler fail to teach cleat systems that provide increased lateral stability and traction. There is a need in the art for a design that solves this problem.

SUMMARY OF THE INVENTION

An article of footwear including heel traction elements is disclosed. The article of footwear may be associated with one or more cleats. The term "cleat" as used throughout this detailed description and in the claims refers to any portion of a sole that is configured to engage a ground surface and penetrate or interweave with that surface. Examples of ground surfaces include, but are not limited to, natural turf, synthetic turf, dirt, as well as other surfaces. It should be understood that the term cleat is not limited to portions of a sole that penetrate through a ground surface. In some cases, as with Astroturf, a cleat may only interweave with various fibers associated with the turf, and may not penetrate through the Astroturf.

In one aspect, the invention provides an article of footwear, comprising: a sole including a forefoot portion; a plurality of primary cleats disposed in an outer peripheral zone of the forefoot portion; a plurality of secondary cleats disposed in the outer peripheral zone, the plurality of secondary cleats having a different shape than the plurality of primary cleats; and where there is at least one secondary cleat disposed between two adjacent primary cleats.

In another aspect, two or more secondary cleats are disposed between the two adjacent primary cleats.

In another aspect, at least one secondary cleat is disposed between substantially every two adjacent primary cleats.

In another aspect, the plurality of primary cleats and the plurality of secondary cleats present a walled cleat system on a portion of the outer peripheral zone.

In another aspect, the sole includes at least one toe cleat disposed in the outer peripheral zone.

In another aspect, the sole includes two toe cleats disposed between two adjacent primary cleats at a forward tip portion of the sole.

In another aspect, the invention provides an article of footwear, comprising: a sole including a forefoot portion; a plurality of primary cleats disposed in an outer peripheral zone of the forefoot portion; a plurality of secondary cleats disposed in the outer peripheral zone; and where an arrangement of the plurality of primary cleats with the plurality of secondary cleats presents a walled cleat system on a portion of the outer peripheral zone.

In another aspect, the walled cleat system is associated with a substantial entirety of the outer peripheral zone.

In another aspect, the portion of the outer peripheral zone is a medial portion.

In another aspect, the portion of the outer peripheral zone is a lateral portion.

In another aspect, at least one secondary cleat is disposed between two adjacent primary cleats.

In another aspect, the plurality of primary cleats are associated with a first height H1 that is larger than a second height H2 associated with the secondary cleats.

In another aspect, the walled cleat system is configured to increase traction and support to the sole.

In another aspect, the invention provides an article of footwear, comprising: a sole including a forefoot portion; a plurality of primary cleats disposed on an outer peripheral zone of the forefoot portion; a forward tip portion of the forefoot portion, the forward tip portion being disposed furthest from a heel portion of the sole; and a first toe cleat and a second first toe cleat disposed adjacent to one another on the forward tip portion.

In another aspect, the first toe cleat and the second toe cleat have a substantially bladed shape.

In another aspect, the first toe cleat and the second toe cleat each include a first rounded portion with a first angle of inclination and a second rounded portion with a second angle of inclination that is different from the first angle of inclination.

In another aspect, the first toe cleat and the second toe cleat are disposed between adjacent primary cleats.

In another aspect, the first toe cleat and the second toe cleat form a portion of a walled cleat system.

In another aspect, the first rounded portion is generally coincident with an outer peripheral edge of the sole.

In another aspect, the sole includes a plurality of secondary cleats disposed in the outer peripheral zone.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
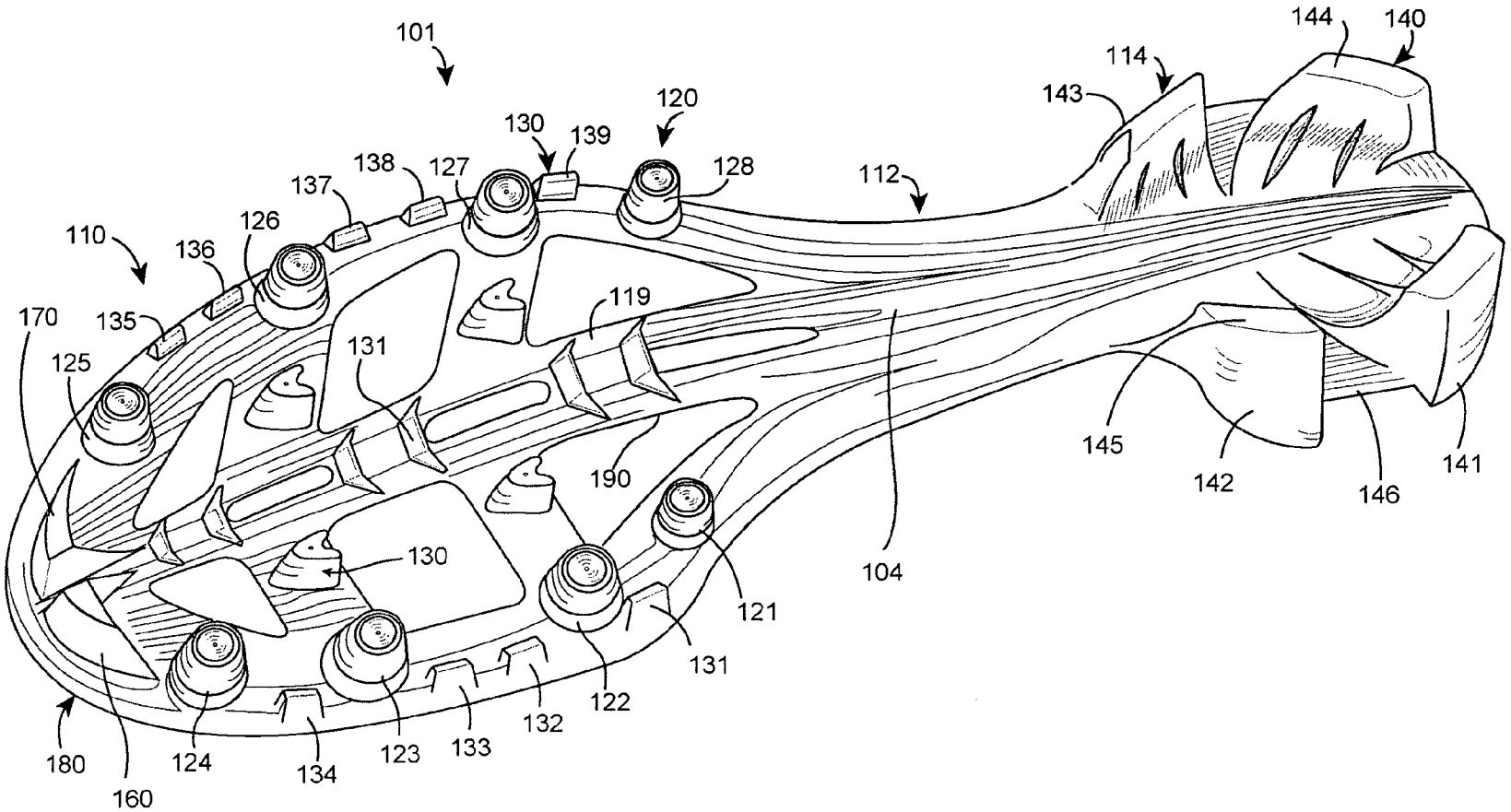
FIG. 1 is an isometric view of a preferred embodiment of an article of footwear with a sole.

FIG. 1 is a preferred embodiment of sole 101. For clarity, the following detailed description discusses a preferred embodiment in the form of a sole for a football shoe, but it should be noted that the present invention could be configured for any type of footwear, including, but not limited to, soccer boots, rugby shoes, baseball shoes as well as other kinds of footwear. As shown throughout the figures, sole 101 is intended to be used with a left foot. However, it should be understood that the following discussion may equally apply to a mirror image of sole 101 that is intended for use with a right foot.

Sole 101 may be made from any materials known in the art for making articles of footwear. For example, sole 101 may be made from any suitable material, including, but not limited to, elastomers, siloxanes, natural rubber, other synthetic rubbers, aluminum, steel, natural leather, synthetic leather, or plastics. In a preferred embodiment, sole 101 may be made of a durable plastic.

Preferably, sole 101 includes forefoot portion 110, arch portion 112 and heel portion 114. Also, sole 101 preferably includes bottom surface 104. Bottom surface 104 is preferably configured to contact a surface, such as grass or synthetic turf. In some embodiments, bottom surface 104 may also include an outer member or other components. Sole 101 may also include a top surface disposed opposite of bottom surface 104 that is configured to attach to an upper, a midsole or an insole of an article of footwear.

In some embodiments, sole 101 may include holes 190. Generally, holes 190 may be disposed on any portion of sole 101. In some cases, holes 190 may be provided on forefoot portion 110. In other cases, holes 190 may be provided on other portions of sole 101. In other embodiments, sole 101 may not include any holes. In a preferred embodiment, sole 101 may only include holes on forefoot portion 110 in order to increase the flexibility of forefoot portion 110.

Preferably, a sole includes provisions for increasing traction with a surface, such as grass or synthetic turf. In some cases, these provisions may be cleats. In some embodiments, the sole may be associated with a plurality of primary cleats. Additionally, the sole may be associated with a plurality of secondary cleats configured to provide support for the primary cleats.

In this embodiment, sole 101 may include primary cleat set 120. Preferably, primary cleat set 120 may be associated with forefoot portion 110. Primary cleat set 120 preferably comprises first primary cleat 121, second primary cleat 122, third primary cleat 123, fourth primary cleat 124, fifth primary cleat 125, sixth primary cleat 126, seventh primary cleat 127 and eighth primary cleat 128. Using this arrangement, primary cleat set 120 may be configured to penetrate into a ground surface and provide traction for a player in all directions.

Although this preferred embodiment includes eight primary cleats, in other embodiments, a different number of primary cleats may be disposed on forefoot portion 110. Also, the arrangement of primary cleats on sole 101 could vary in other embodiments. Furthermore, in some embodiments, one or more primary cleats could be disposed on other portions of sole 101. In some cases, one or more primary cleats could also be disposed on arch portion 112 of sole 101. In other cases, one or more primary cleats could also be disposed on heel portion 114 of sole 101.

Generally, primary cleats 121-128 may have any shape. In some cases, primary cleats 121-128 may be rounded. In other cases, primary cleats 121-128 may have a rectangular or polygonal shape. In still other cases, primary cleats 121-128 may have an irregular shape. In a preferred embodiment, each of the primary cleats 121-128 may have a conical shape, including a flattened ground engaging tip.

Primary cleats 121-128 may be attached to sole 101 using any known method. In some cases, primary cleats 121-128 may be detachable cleats that are screwed into sole 101. In other cases, primary cleats 121-128 may be integrally formed with sole 101 during a molding process. In still other embodiments, primary cleats 121-128 may be attached to sole 101 using an adhesive of some kind.

Sole 101 may also include secondary cleat set 130 including multiple secondary cleats that are configured to provide support for primary cleats 121-128. Preferably, secondary cleat set 130 may also be associated with forefoot portion 110. In this case, secondary cleat set 130 may comprise first secondary cleat 131, second secondary cleat 132, third secondary cleat 133, fourth secondary cleat 134, fifth secondary cleat 135, sixth secondary cleat 136, seventh secondary cleat 137, eighth secondary cleat 138 and ninth secondary cleat 139. Using this preferred arrangement, secondary cleat set 130 may be configured to partially penetrate a ground surface and provide additional traction and support for sole 101.

Although this preferred embodiment includes nine secondary cleats, in other embodiments a different number of secondary cleats may be disposed on forefoot portion 110. Also, the arrangement of secondary cleats on sole 101 could vary in other embodiments. Furthermore, in some embodiments, one or more secondary cleats could be disposed on other portions of sole 101. In some cases, one or more secondary cleats could also be disposed on arch portion 112 of sole 101. In other cases, one or more secondary cleats could also be disposed on heel portion 114 of sole 101.

Generally, secondary cleats 131-139 may have any shape. In some cases, secondary cleats 131-139 may have a generally oblong shape. In particular, secondary cleats 131-139 may have a generally rectangular base and a generally rectangular ground engaging tip. In other cases, secondary cleats 131-139 could have another shape, including rounded shapes or irregular shapes.

Secondary cleats 131-139 may be attached to sole 101 using any known method. In this preferred embodiment, secondary cleats 131-139 may be integrally formed with sole 101. In other embodiments, however, secondary cleats 131-139 may be attached using an adhesive of some kind.

Preferably, sole 101 includes provisions for engaging the ground at a forward-most portion of forefoot portion 110. In this embodiment, forefoot portion 110 includes forward tip portion 180. Forward tip portion 180 is a portion of sole 101 that is disposed furthest from heel portion 114. In this preferred embodiment, forward tip portion 180 may be further associated with first toe cleat 160 and second toe cleat 170. With this arrangement, toe cleats 160 and 170 may be configured to engage a ground surface when a wearer plants his or her toes on the ground surface.

Sole 101 may include provisions for engaging the ground at heel portion 114. In this embodiment, sole 101 preferably includes heel cleat set 140. Preferably, heel cleat set 140 comprises first heel cleat 141, second heel cleat 142, third heel cleat 143 and fourth heel cleat 144. Although the current embodiment includes four heel cleats, in other embodiments a different number of heel cleats may be included.

Generally, heel cleats 141-144 may be attached to heel portion 114 using any known method. In some embodiments, heel cleats 141-144 are integrally formed with heel portion 114 of sole 101. In some cases, heel cleats 141-144 are molded with sole 101. In other embodiments, heel cleats 141-144 may be attached at heel portion 114 using another method such as an adhesive.

In some embodiments, heel cleats 141-144 may protrude slightly from heel periphery 146 of heel portion 114. Additionally, heel cleats 141-144 may be associated with flat surfaces 145 that are configured to engage a ground surface. Using this arrangement, heel cleats 141-144 may increase the width of the contact area between heel portion 114 and a ground surface and thereby provide increased support and traction at heel portion 114.

A sole may include components other than cleats that contact a playing surface and increase traction. In some embodiments, a sole may also include traction elements that are smaller than traditional cleats or studs. Traction elements on the sole of an article of footwear may increase control for a wearer when maneuvering forward on a surface by engaging the surface. Additionally, traction elements may also increase stability of the wearer when making lateral movements by digging into a playing surface. Generally, traction elements may be used in addition to cleats or without cleats. In this preferred embodiment, sole 101 is configured with traction elements as well as cleats.

In some embodiments, traction elements may be disposed on any portion of a sole. In some cases, for example, traction elements may be disposed on a forefoot portion of the sole. In other embodiments, traction elements may be disposed on an arch portion of a sole. In still other embodiments, traction elements may be disposed on a heel portion of a sole. In a preferred embodiment, traction elements may be disposed only on a forefoot portion of a sole, including a central region of the forefoot portion.

In this embodiment, sole 101 may include forefoot traction elements 130 disposed on a forefoot portion 110. Preferably, forefoot traction elements 130 include four traction elements located proximally to second primary cleat 122, third primary cleat 123, sixth primary cleat 126 and seventh primary cleat 127 on forefoot portion 110. In addition, central traction elements 131 may be disposed on central region 119 of forefoot portion 110. In this embodiment, central traction elements 131 may include six traction elements disposed in a line on central region 119. In other embodiments, the number of traction elements may vary. Generally, traction elements may be disposed in any location and in any design on sole 101 to increase the traction of an article of footwear when a wearer is maneuvering forward or laterally.

In some embodiments, traction elements may be pod-like protrusions from a bottom surface of a sole. In other embodiments, traction elements may be rounded or cylindrical. Generally, traction elements may have any shape that increases traction and that does not interfere with maneuverability. In a preferred embodiment, traction elements have a fin-like shape.

In this embodiment, forefoot traction elements 130 and central traction elements 131 have a fin-like shape. This fin-like shape has a sloped portion and a substantially perpendicular portion. Preferably, the sloped portions of traction elements 130 and 131 face forward. Furthermore, the sides of traction elements 130 and 131 are preferably rounded. This smooth curvature at the front and sides of traction elements 130 and 131 allows a wearer to run forward or laterally with little resistance from traction elements 130 and 131.

Preferably, the substantially perpendicular portion of each of the traction elements 130 and 131 faces backward to provide traction in the forward direction. As the substantially perpendicular portion of each of the traction elements 130 and 131 contacts a surface, the substantially perpendicular portion may dig into the surface. This arrangement may provide traction for a wearer when moving forward or laterally and may be helpful in preventing a wearer from sliding backward.

Figure 2:
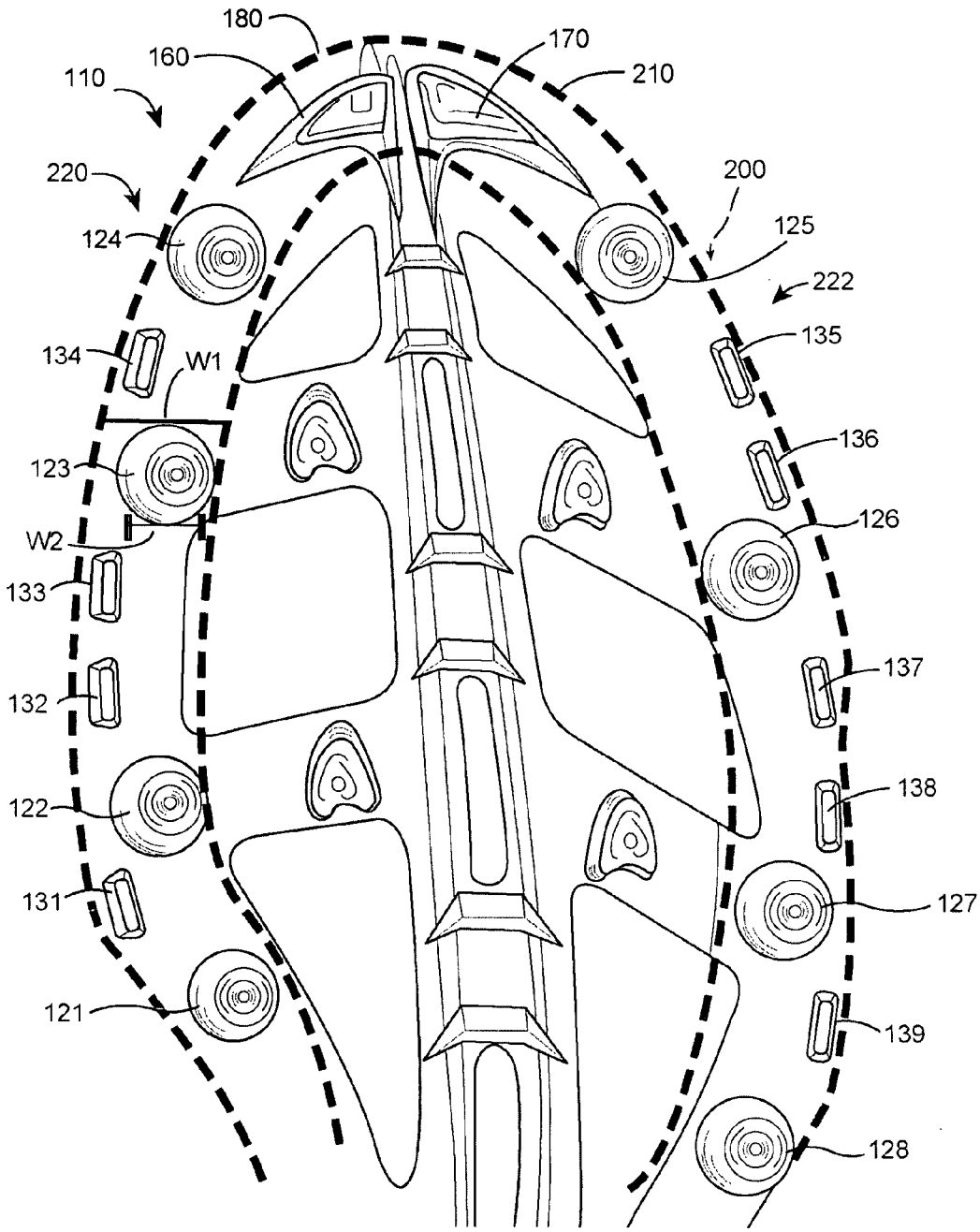
FIG. 2 is an enlarged plan view of a preferred embodiment of a forefoot portion of a sole.

Referring to FIG. 2, a sole preferably includes provisions for increasing traction and stability on an outer periphery of a forefoot portion. In this embodiment, forefoot portion 110 preferably includes outer peripheral zone 200. The term "outer peripheral zone" as used throughout this detailed description and in the claims refers to a zone on the periphery of forefoot portion 110. Preferably, outer peripheral zone 200 has an outer boundary that is approximately coincident with outer peripheral edge 210 of forefoot portion 110 and has an average width W1 over forefoot portion 110. In this embodiment, the value of W1 is approximately equal to one and a half times the width of a primary cleat, indicated at width W1 in the current embodiment. In other embodiments, the value of width W1 may vary. For example, in some cases, the value of width W1 may be approximately equal to the width of a primary cleat. In other cases, the value of width W1 may be approximately equal to two times the width of a single cleat.

In the current embodiment, outer peripheral zone 200 only extends over forefoot portion 110. In other embodiments, however, an outer peripheral zone could extend to an arch portion or a heel portion of a sole.

In a preferred embodiment, primary cleats 121-128 may be disposed in outer peripheral zone 200. Additionally, secondary cleats 131-139 may be disposed in outer peripheral zone 200. Furthermore, toe cleats 160 and 170 may also be disposed in outer peripheral zone 200. In other words, primary cleats 121-128, secondary cleats 131-139 and toe cleats 160 and 170 may be disposed proximally to the periphery of sole 101.

In some embodiments, primary cleats and secondary cleats may be disposed in only a portion of an outer peripheral zone. In some cases, primary cleats and secondary cleats may be disposed in only a medial portion of the outer peripheral zone. In other cases, primary cleats and secondary cleats may be disposed in only a lateral portion of the outer peripheral zone. In a preferred embodiment, primary cleats and secondary cleats may be disposed in both the medial portion and the lateral portion of the outer peripheral zone.

In this preferred embodiment, primary cleats 121-124 and secondary cleats 131-134 may be disposed in medial portion 220 of outer peripheral zone 200. Likewise, primary cleats 125-128 and secondary cleats 135-139 may be disposed in lateral portion 222 of outer peripheral zone 200. Preferably, first toe cleat 160 and second toe cleat 170 may also be disposed in outer peripheral zone 200 as well. With this preferred arrangement, primary cleats 121-128, secondary cleats 131-139 and toe cleats 160 and 170 may fill the substantial entirety of outer peripheral zone 200. This arrangement preferably helps to increases traction and stability over a majority of outer peripheral zone 200, which may generally increase traction and stability for sole 101.

Preferably, a sole includes provisions for providing support to primary cleats to increase traction and stability. In some embodiments, one or more secondary cleats may be disposed between adjacent primary cleats. This alternating cleat arrangement may provide increased stability to the outer periphery of the forefoot portion.

Referring to FIG. 2, primary cleats 121-124 may alternate with secondary cleats 131-134 within medial portion 220 of outer peripheral zone 200. In this case, first primary cleat 121 and second primary cleat 122 may be disposed adjacent to one another. Preferably, first secondary cleat 131 is disposed between primary cleats 121 and 122. Also, second primary cleat 122 and third primary cleat 123 are disposed adjacent to one another. Preferably, second secondary cleat 132 and third secondary cleat 133 are disposed between primary cleats 122 and 123. Finally, third primary cleat 123 and fourth primary cleat 124 are also disposed adjacent to one another. Preferably, fourth secondary cleat 134 is disposed between primary cleats 123 and 124. With this alternating cleat arrangement, secondary cleats 131-134 may provide additional support to primary cleats 121-124.

Additionally, primary cleats 125-128 may alternate with secondary cleats 135-139 within lateral portion 222 of outer peripheral zone 200. In this case, fifth primary cleat 125 and sixth primary cleat 126 are disposed adjacent to one another. Preferably, fifth secondary cleat 135 and sixth secondary cleat 136 may be disposed between primary cleats 125 and 126. Likewise, sixth primary cleat 126 and seventh primary cleat 127 are disposed adjacent to one another. Preferably, seventh secondary cleat 137 and eighth secondary cleat 138 are disposed between primary cleats 126 and 127. Finally, seventh primary cleat 127 and eighth primary cleat 128 are disposed adjacent to one another. Preferably, ninth secondary cleat 139 is disposed between primary cleats 127 and 128. With this alternating arrangement, secondary cleats 135-139 may provide additional support to primary cleats 125-128.

As previously discussed, this alternating arrangement may provide increased support for primary cleats 121-128. For example, in cases where the forefoot portion of sole 101 engages a ground surface, secondary cleats 131-139 may provide additional contact points for sole 101 to apply traction to the ground surface. This may be especially useful during lateral movements as the forefoot portion may tilt slightly to the left or to the right. In these cases, secondary cleats 131-139 provide extra traction at the outer periphery of forefoot portion 110 as forefoot portion 110 leans towards either the lateral or medial sides of the sole.

In the current embodiment, one or more secondary cleats may be disposed between every two adjacent primary cleats. Generally, the number of secondary cleats disposed between adjacent primary cleats may vary. In some cases, the number may range between 1 and 2 secondary cleats. In other cases, the number may range between 1 and 5 secondary cleats. In still other cases, the number may be greater than 5. In other embodiments, some pairs of adjacent cleats may not include secondary cleats disposed between them.

Preferably, primary cleats and secondary cleats are arranged in an outer peripheral zone in a manner that presents a walled cleat system. The term "walled cleat system" as used throughout this detailed description and in the claims refers to any system of primary and secondary cleats that are arranged in a manner that presents a wall-like surface or edge on an outer periphery of a sole. In some embodiments, the walled cleat system may extend through a portion of the outer peripheral zone. In other embodiments, the walled cleat system may extend through the entirety of the outer peripheral zone.

Figure 3:
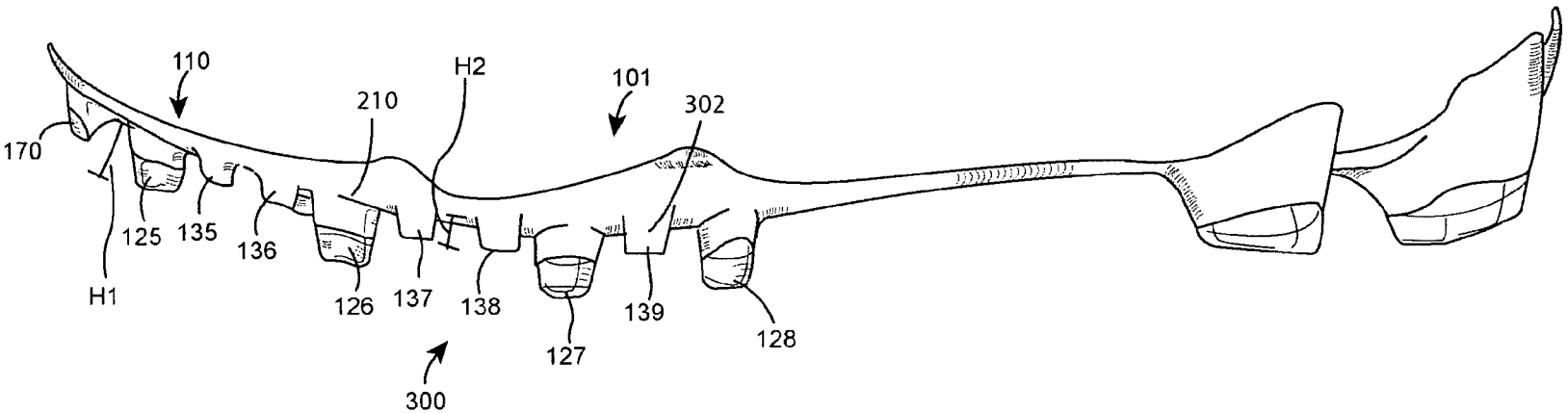
FIG. 3 is a side view of a preferred embodiment of a sole.
Figure 4:
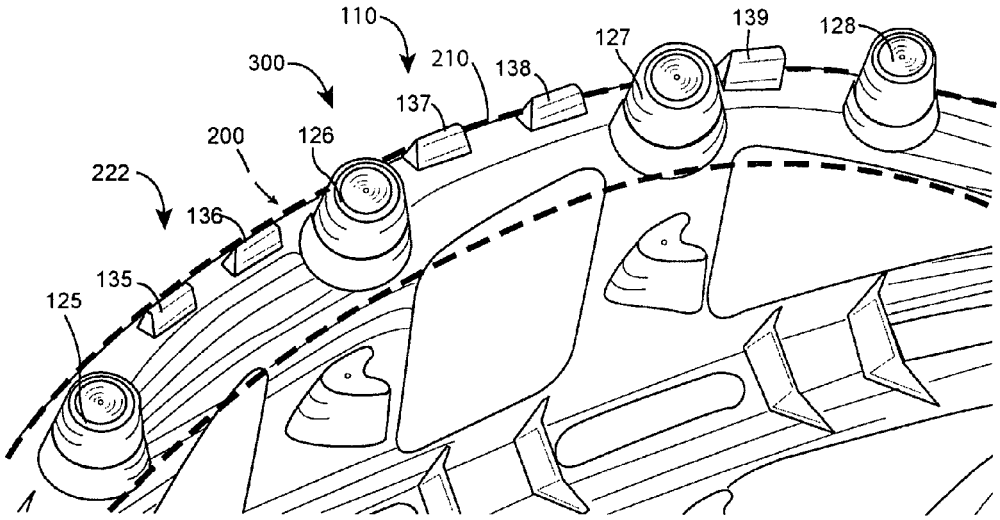
FIG. 4 is an enlarged isometric of a preferred embodiment of a sole with cleat and traction elements.

Referring to FIGS. 3-4, primary cleats 125-128 are preferably arranged with secondary cleats 135-139 to form a portion of walled cleat system 300. Preferably, primary cleats 125-128 are aligned with secondary cleats 135-139 to form a wall-like outer surface at outer peripheral zone 200. In some embodiments, secondary cleats 135-139 are oriented with long sidewall portions 302 facing outwards with respect to forefoot portion 110. In particular, long sidewall portions 302 are generally aligned in parallel with outer peripheral edge 210 of forefoot portion 110. This arrangement presents the greatest surface area of secondary cleats 135-139 along outer peripheral edge 210 of forefoot portion 110. Using this arrangement, as primary cleats 125-128 engage the ground, secondary cleats 135-139 help to prevent sliding in the lateral direction. This may be useful during lateral maneuvers, for example, when a running back in football cuts left, to prevent the sole from sliding laterally once the primary cleats have been planted.

Preferably, primary cleats 121-124 are arranged with secondary cleats 131-134 to form a portion of walled cleat system 300 as well, as seen in FIG. 2. In particular, the orientation of secondary cleats 131-134 with respect to medial portion 220 is similar to the orientation of secondary cleats 135-139 with respect to lateral portion 222. This arrangement preferably provides support to forefoot portion 110 at lateral portion 222 during lateral maneuvers.

Referring to FIG. 3, the heights of primary cleats 121-128 may be differ from the heights of secondary cleats 131-139. In this embodiment, primary cleats 125-128 may be associated with an average height H1, while secondary cleats 135-139 may be associated with an average height H2. Preferably, primary cleats 121-124 are also associated with average height H1 and secondary cleats 135-139 are also associated with average height H2. Since height H2 is substantially less than height H1, primary cleats 121-128 may be configured to engage the ground before secondary cleats 131-139. Using this arrangement, cleat wall system 300 may provide increased traction by engaging the ground at two distinct heights.

Preferably, a forefoot portion includes provisions for extending a walled cleat system across a forward-most portion of a sole. In some embodiments, one or more toe cleats may be arranged with primary cleats and secondary cleats to form a forward portion of a walled cleat system.

Figure 5:
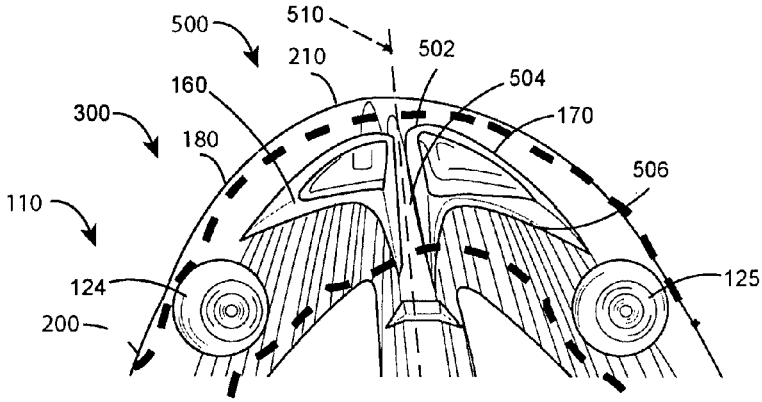
FIG. 5 is an enlarged plan view of a preferred embodiment of toe cleats.

Referring to FIG. 5, first toe cleat 160 and second toe cleat 170 may be disposed between adjacent primary cleats to form a forward portion of a walled cleat system. In the current embodiment, first toe cleat 160 and second toe cleat 170 may be disposed between primary cleats 124 and 125. This arrangement of cleats 124, 125, 160 and 170 preferably presents forward portion 500 of walled cleat system 300. The gap between first toe cleat 160 and second toe cleat 170 provides longitudinal flexing in the toe region.

Preferably, the shape of toe cleats 160 and 170 may help to present a substantially continuous wall-like surface at forward tip portion 180 of forefoot portion 110. In some embodiments, toe cleats 160 and 170 may be substantially similar in shape. In a preferred embodiment, first toe cleat 160 and second toe cleat 170 are complementary and form mirror images of one another with respect to central axis 510 that runs generally longitudinally with respect to forefoot portion 110. Therefore, while the following description discusses the shape of second toe cleat 170, it should be understood that first toe cleat 160 may be configured to have substantially similar characteristics. In other words, the following discussion could also apply to first toe cleat 160.

Referring to FIG. 5, second toe cleat 170 may comprise first rounded portion 502, second rounded portion 504 and third rounded portion 506. In this embodiment, first rounded portion 502 may be generally coincident in shape with, and have a similar orientation to, outer peripheral edge 210 of forefoot portion 110. Furthermore, second rounded portion 504 may be disposed in a generally longitudinal direction. Finally, third rounded portion 506 may be oriented in a generally rearwards direction and may have a bowed or U-like shape. With this arrangement, first rounded portion 502 of second toe cleat 170 may be approximately coincident with an outer boundary of outer peripheral zone 200. Similarly, a complementary rounded portion of first toe cleat 160 may be approximately coincident with an outer boundary of outer peripheral zone 200. This arrangement allows first toe cleat 160 and second toe cleat 170 to provide additional support for walled cleat system 300 at forward tip portion 180.

Figure 6:
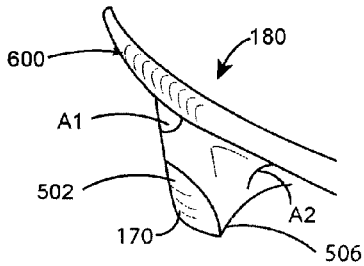
FIG. 6 is an enlarged side view of a preferred embodiment of a toe cleat.

Referring to FIG. 6, rounded portions 502 and 506 of second toe cleat 170 may be also be sloped with respect to outer surface 600 of forward tip portion 180 in order to facilitate penetration into a ground surface. In particular, first rounded portion 502 and third rounded portion 506 may have different angles of inclination with respect to outer surface 600 of forward top portion 180. In this embodiment, first rounded portion 502 may form an inclination angle A1 with outer surface 600. Likewise, second rounded portion 506 may form an inclination angle A2 with outer surface 600. In some embodiments, inclination angles A1 and A2 may both be less than 90 degrees. In a preferred embodiment, angles A1 and A2 may vary in the range between 20 degrees and 70 degrees. This preferred arrangement helps to minimize traction at first rounded portion 502, as first rounded portion 502 is sloped in a manner to minimize forward drag. This allows first rounded portion 502 to easily move forwards as second toe cleat 170 is penetrating into a ground surface. Additionally, this preferred arrangement helps to increase traction at third rounded portion 506, as third rounded portion 506 is sloped in a manner to increase traction with a ground surface during forwards movement.

Figure 7:
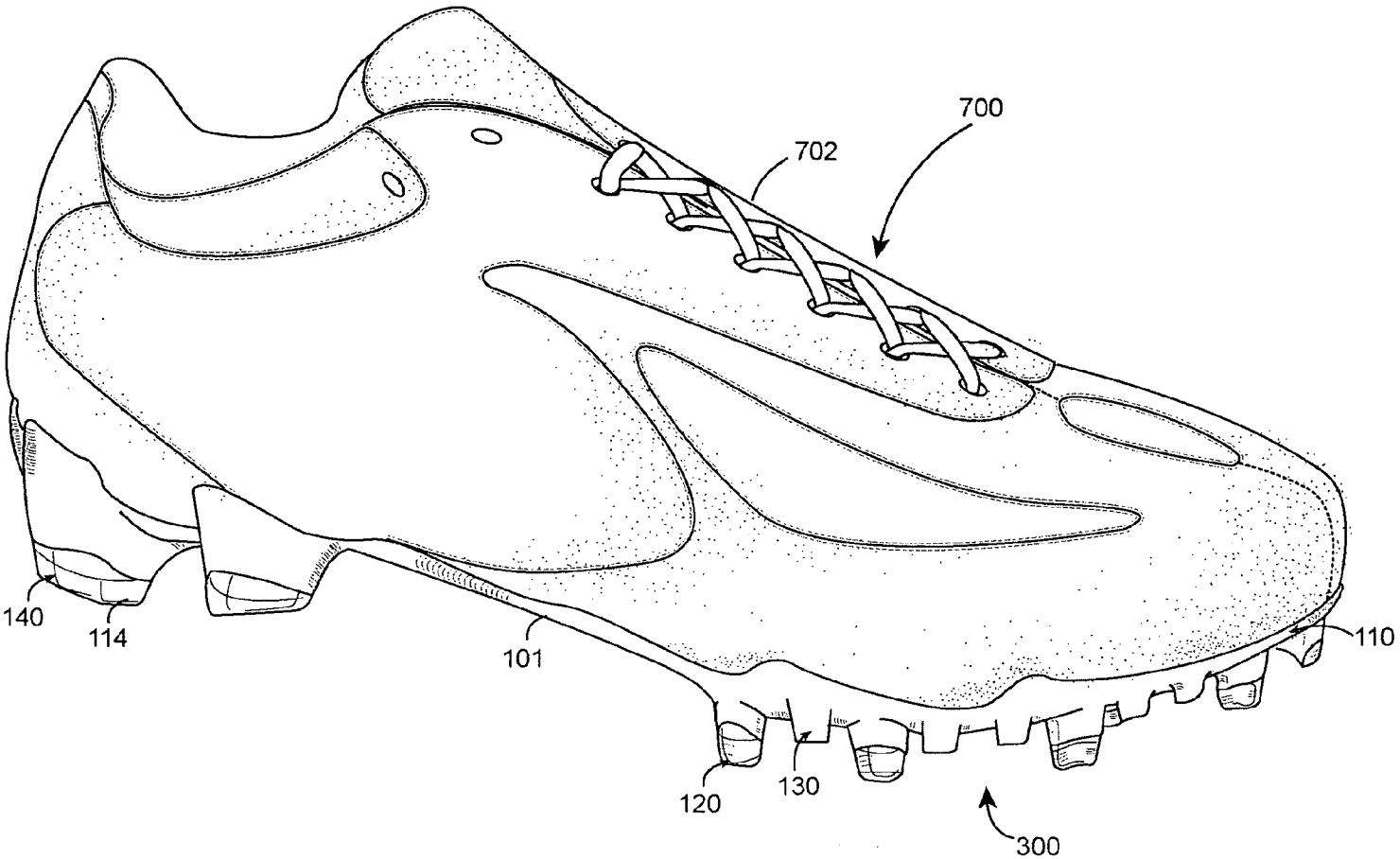
FIG. 7 is an isometric view of a preferred embodiment of an article of footwear with a walled cleat system.

FIG. 7 illustrates a preferred embodiment of article of footwear 700, including sole 101 configured with walled cleat system 300. In this embodiment, sole 101 may be associated with upper 702. Upper 702 is preferably configured to receive a foot. The current embodiment includes a generic design for upper 702. In other embodiments, the design of upper 702 may be modified. Generally, any design for upper 702 may be used.

Article of footwear 700 may be configured to provide traction and support to a wearer at forefoot portion 110 through primary cleat set 120 and secondary cleat set 130. In particular, using the provisions discussed previously, cleat sets 120 and 130 may present a walled cleat system 300 to increase lateral support and stability. Preferably, article of footwear 700 may also be configured to provide additional traction and support to a wearer at heel portion 114 through heel cleat set 140.

While various embodiments of the invention have been described, the description is intended to be exemplary, rather than limiting, and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

a sole including a forefoot portion and a forward tip portion, wherein a central axis runs longitudinally along a central region of the forefoot portion;

a plurality of primary cleats disposed in an outer peripheral zone of the forefoot portion;

a plurality of secondary cleats disposed in the outer peripheral zone, the plurality of secondary cleats having a different shape than the plurality of primary cleats; and wherein there is at least one secondary cleat disposed between two adjacent primary cleats;

at least one toe cleat disposed in the outer peripheral zone adjacent to the forward tip portion, the toe cleat having a first end, the first end having a first width, wherein the first end is located adjacent to the central axis, wherein the toe cleat extending from the first end away from the central axis towards a second end, the second end having a second width, wherein the first width is greater than the second width.

2. The article of footwear according to claim 1, wherein two or more secondary cleats are disposed between the two adjacent primary cleats.

3. The article of footwear according to claim 1, wherein at least one secondary cleat is disposed between substantially every two adjacent primary cleats.

4. The article of footwear according to claim 1, wherein the plurality of primary cleats and the plurality of secondary cleats and the at least one toe cleat collectively fills a substantial entirety of a portion of the outer peripheral zone in the forefoot portion.

5. The article of footwear according to claim 1, wherein the sole includes a first toe cleat and a second toe cleat disposed in the outer peripheral zone adjacent to the forward tip portion, wherein the first toe cleat and the second toe cleat form mirror images of one another with respect to the central axis.

6. The article of footwear according to claim 1, further comprising multiple central traction elements disposed in a line along a central region of the forefoot portion.

7. An article of footwear, comprising:

a sole including a forefoot portion;

a plurality of primary cleats disposed in an outer peripheral zone of the forefoot portion;

a plurality of secondary cleats disposed in the outer peripheral zone, wherein the plurality of secondary cleats have a different shape than the plurality of primary cleats;

wherein each secondary cleat has a substantially oblong shape, wherein each secondary cleat having a sidewall portion facing an outer peripheral edge of the forefoot portion, wherein each secondary cleat is positioned closer to the outer peripheral edge than each primary cleat.

8. The article of footwear according to claim 7, wherein the sidewall portion of each secondary cleat abuts the outer peripheral edge of the forefoot portion.

9. The article of footwear according to claim 7, wherein two or more secondary cleats are disposed between two adjacent primary cleats.

10. The article of footwear according to claim 7, further comprising at least one central traction element disposed in a central region of the forefoot portion.

11. The article of footwear according to claim 7, wherein at least one secondary cleat is disposed between two adjacent primary cleats.

12. The article of footwear according to claim 7, wherein the plurality of primary cleats have an average height H1 and the plurality of secondary cleats have an average height H2, wherein average height H2 is less than average height H1.

13. The article of footwear according to claim 7, wherein the plurality of primary cleats have a conical shape including a flattened ground engaging tip.

14. An article of footwear, comprising:

a sole including a forefoot portion;

a plurality of primary cleats disposed on an outer peripheral zone of the forefoot portion, wherein each primary cleat is located some distance from the outer peripheral edge of the forefoot portion;

a forward tip portion of the forefoot portion, the forward tip portion being disposed furthest from a heel portion of the sole;

a plurality of secondary cleats disposed in the outer peripheral zone, wherein the plurality of primary cleats having a different shape than the plurality of secondary cleats, each secondary cleat having a substantially oblong shape, each secondary cleat abuts an outer peripheral edge of the forefoot portion; and a first toe cleat and a second first toe cleat disposed adjacent to one another on the forward tip portion.

15. The article of footwear according to claim 14, wherein the width of the first toe cleat tapers as the first toe cleat extends away from a central region of the forward tip portion, and the width of the second toe cleat tapers as the second toe cleat extends away from the central region of the forward tip portion.

16. The article of footwear according to claim 15, wherein the first toe cleat and the second toe cleat each include a first rounded portion with a first angle of inclination and a second rounded portion with a second angle of inclination that is different from the first angle of inclination.

17. The article of footwear according to claim 14, wherein the first toe cleat and the second toe cleat are disposed between adjacent primary cleats.

18. The article of footwear according to claim 17, wherein the first toe cleat and the second toe cleat collectively fills a substantial entirety of the portion of the outer peripheral zone on the forward tip portion.

19. The article of footwear according to claim 16, wherein the first and second toe cleat are shaped as mirror-images of each other across a central axis of the article of footwear.

20. The article of footwear according to claim 14, further comprising multiple central traction elements disposed in a line along a central region of the forefoot portion.

* * * * *